US005131357A

United States Patent [19]

Inoue et al.

[11] Patent Number: 5,131,357

[45] Date of Patent: Jul. 21, 1992

[54] CYLINDER BLOCK FOR V-TYPE ENGINE

[75] Inventors: Yasushi Inoue, Higashihiroshima; Shigeki Nakatani, Hiroshima; Yutaka Nishinaga, both of Hiroshima; Hajime Suetsugu, Higashihiroshima; Takashi Sakono; Seiji Nanba, both of Hiroshima, all of Japan

[73] Assignee: Mazda Motor Corporation, Hiroshima, Japan

[21] Appl. No.: 677,538

[22] Filed: Apr. 1, 1991

[30] Foreign Application Priority Data

Mar. 31, 1990 [JP] Japan ..... 2-35277[U]

[51] Int. Cl.[5] ..... F02F 7/00

[52] U.S. Cl. ..... 123/195 R; 123/41.10; 123/55 V; 123/425; 123/195 H; 180/312

[58] Field of Search ..... 123/55 V, 55 VF, 55 VS, 123/55 VE, 41.10, 195 R, 195 A, 195 H, 425, 435; 180/291, 299, 312; 73/35 R

[56] References Cited

U.S. PATENT DOCUMENTS 2,734,497 2/1956 Chayne ..... 123/195 R
3,086,505 4/1963 Bovard ..... 123/195 R
3,528,397 9/1970 Seifert ..... 123/195 R
4,494,494 1/1985 Yahiro et al. ..... 123/55 VS
4,953,525 9/1990 Sakurai et al. ..... 123/41.1
4,969,441 11/1990 Komusasoki et al. ..... 123/425
4,984,538 1/1991 Nanba ..... 123/41.1

FOREIGN PATENT DOCUMENTS 59-188019 10/1984 Japan .

*Primary Examiner*—Noah P. Kamen
*Attorney, Agent, or Firm*—Fleit, Jacobson, Cohn, Price, Holman & Stern

[57] ABSTRACT

A V-type engine cylinder block includes a mounting pedestal, integrally formed with the block in a V-shaped space between two cylinder banks and interconnecting the cylinder banks. A top wall is secured to the mounting pedestal and extends over almost the entire length of the V-shaped space in a lengthwise direction of the cylinder block. A plurality of bosses are formed with internal threads for securing a bracket, for mounting the cylinder block onto a car body, to one end wall of the cylinder block by bolts. The mounting pedestal and bosses are interconnected by ribs integrally formed with the cylinder block.

5 Claims, 5 Drawing Sheets

CYLINDER BLOCK FOR V-TYPE ENGINE

BACKGROUND OF THE INVENTION

1. Field of the Invention

The present invention relates to the structure of a cylinder block for an automotive engine and, more particularly, to an engine block structure for a V-type internal combustion engine.

2. Description of Related Art

Typically, a known V-type internal combustion engine has a cylinder block and a cylinder head mounted on the cylinder block. The cylinder block consists of two cylinder banks arranged in a V-formation, having a predetermined relative angle, for example, a relative angle of 60 degrees, therebetween. Such a V-type engine, during operation, causes the cylinder banks to rapidly move away from and toward each other and produces vibrations of the cylinder block between the cylinder banks. Such vibrations produce noise in the passenger compartment of a car.

Usually, the V-shaped space between the cylinder banks is utilized so that various elements or structural parts can be installed on the engine. For instance, as is known from Japanese Unexamined Patent Publication No. 59-188019, a pressure buffer chamber for blow-by gas is provided in the V-shaped space formed between the two cylinder banks. For this purpose, the V-type engine is provided with a top wall in the V-shaped space for forming the blow-by gas pressure buffer chamber on the V-type engine. The top wall typically connects the banks, so as to function as a reinforcement for restraining the motion of the banks away from and toward each other. This contributes to reducing vibration of the cylinder block.

SUMMARY OF THE INVENTION

It is a primary object of the present invention to provide an engine block structure which causes an engine block to produce less vibration.

The primary object of the present invention is achieved by providing a novel cylinder block structure for a V-type internal combustion cylinder, which has two cylinder banks, each formed with more than two cylinders arranged in a V-formation, at a predetermined relative angle, so as to form therebetween a V-shaped space. The cylinder block includes mounting means, such as a rib formed in a shape of ladder, integrally formed with the cylinder block in the V-shaped space so as to interconnect the cylinder banks. A top wall, extending along almost the entire length of the V-shaped space, is secured to the mounting means. A plurality of bosses, formed with internal threads and extending into the V-shaped space, secure a bracket for mounting the cylinder block on a car body to one end wall of the cylinder block by bolts. The mounting means and bosses are interconnected by rib means integrally formed with the cylinder block.

The top wall may include a wall section secured to the mounting means and a pipe section integrally formed with the wall section which forms part of a suction pipe of an engine cooling system installed in the engine including the cylinder block.

The mounting means for the top wall is reinforced by the rib means connected to the bosses. This effectively restrains the movement of the cylinder banks away from and toward each other, thereby helping to improve the rigidity of the cylinder block and, therefore, reducing vibration of the cylinder block.

Thus, the rib means reinforces the bosses and, consequently, vibration produced by the engine is prevented from being transmitted to the car body through the mounting bracket, so as to reduce noise in the car body.

BRIEF DESCRIPTION OF THE DRAWINGS

This and other objects and features of the present invention will be apparent to those skilled in the art from the following description of preferred embodiments thereof when considered in conjunction with the accompanying drawings, wherein.

DETAILED DESCRIPTION OF THE PREFERRED EMBODIMENTS

Figure 1:
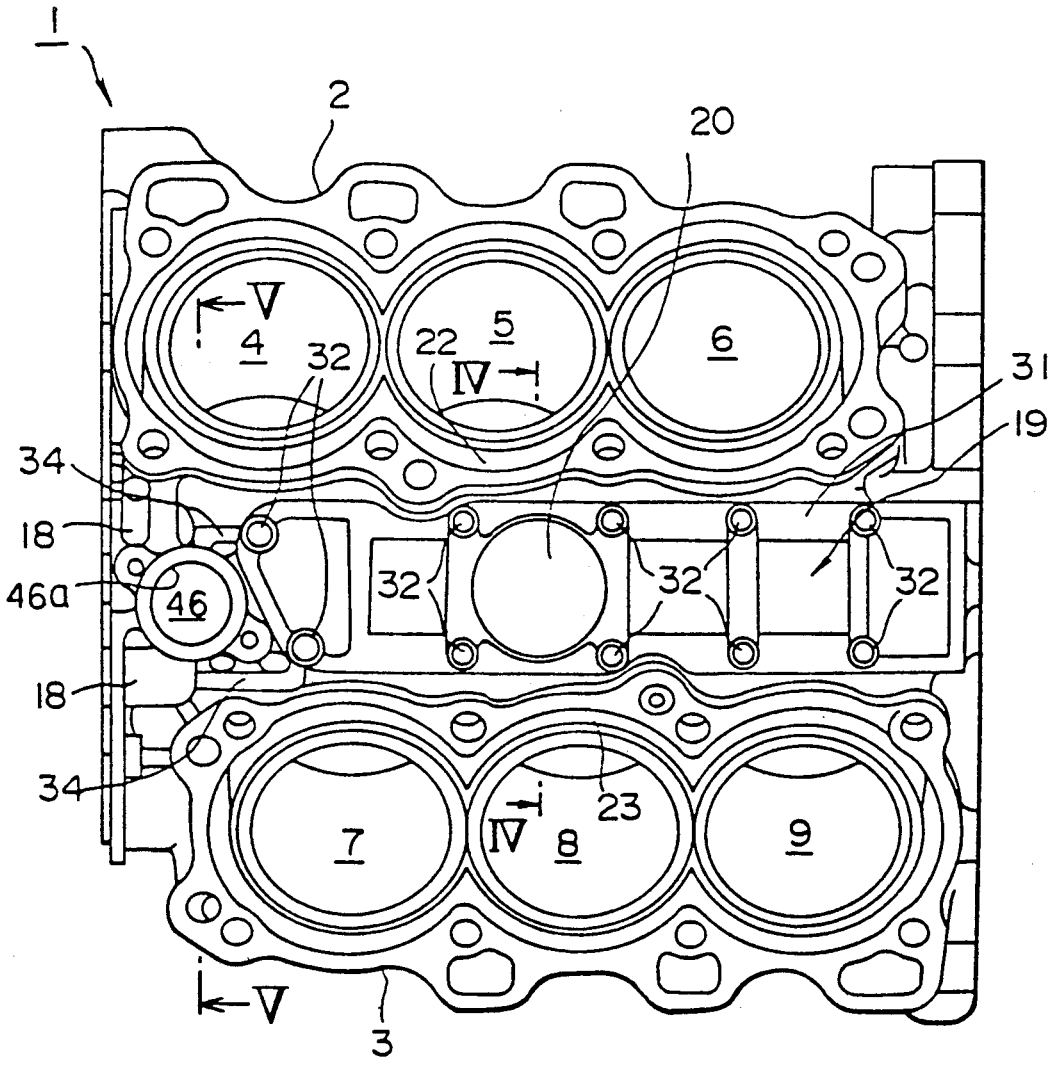
FIG. 1 is a plan view showing a cylinder block of a V-type internal combustion engine in accordance with a preferred embodiment of the present invention.

Referring to the drawings in detail and, in particular, to FIGS. 1 to 8, a cylinder block 1, for a V-type, six-cylinder internal combustion engine, in accordance with a preferred embodiment of the present invention, is shown. The engine includes first and second, or left and right, cylinder banks 2 and 3 arranged in a V-formation with a predetermined relative angle, for example, a relative angle of 60 degrees, therebetween. Each cylinder bank 2 and 3 is formed with three cylinder bores i.e., bores 4, 5, 6 and 7, 8 and 9, respectively, in a straight line. A piston (not shown) slides in each cylinder bore.

The cylinder block 1 is provided with a housing 10 for a water pump A, formed in the front wall 1*a* at almost a center portion. The water pump housing 10 is formed with a center recess 10*a* for allowing a rotor 12 of the water pump A to operate. The water pump housing 10 is further formed with a suction opening 45 opening into the recess 10*a*. Water inlets 10*b* and 10*c* are in communication with water passages (not shown) in the first and second cylinder banks 2 and 3, respectively.

Figure 3:
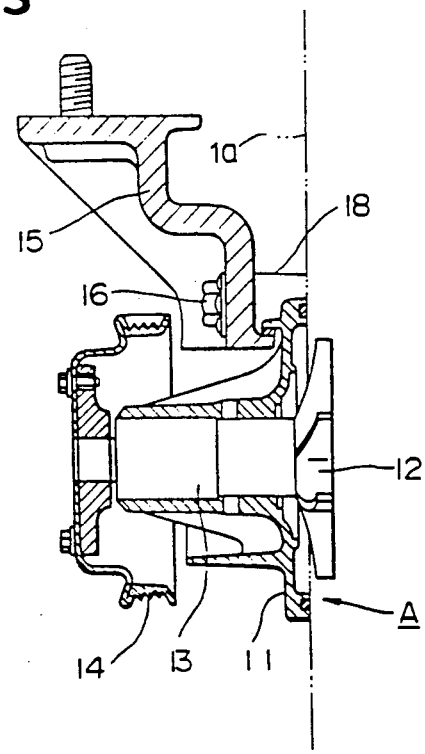
FIG. 3 is a cross-sectional view of a front end part of the cylinder block shown in FIG. 1.
Figure 4:
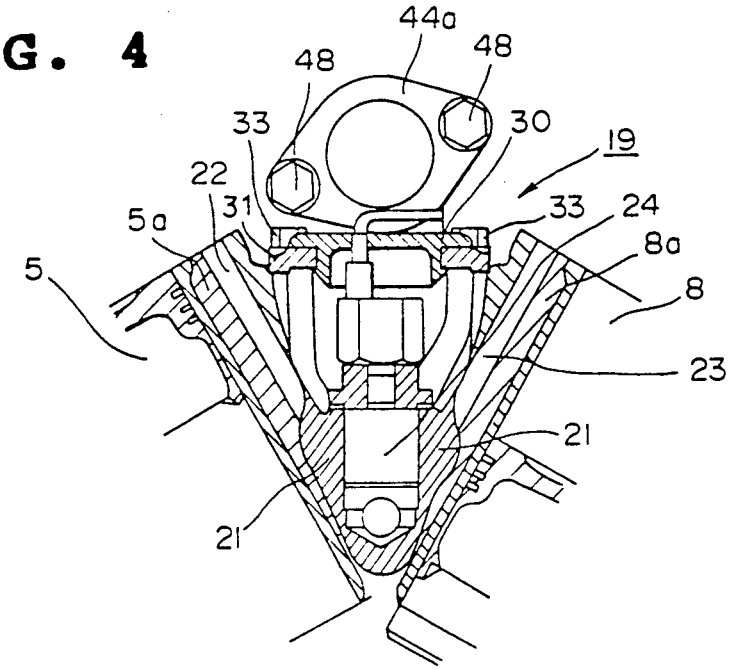
FIG. 4 is a cross-sectional view of FIG. 1 as seen along line IV—IV.
Figure 5:
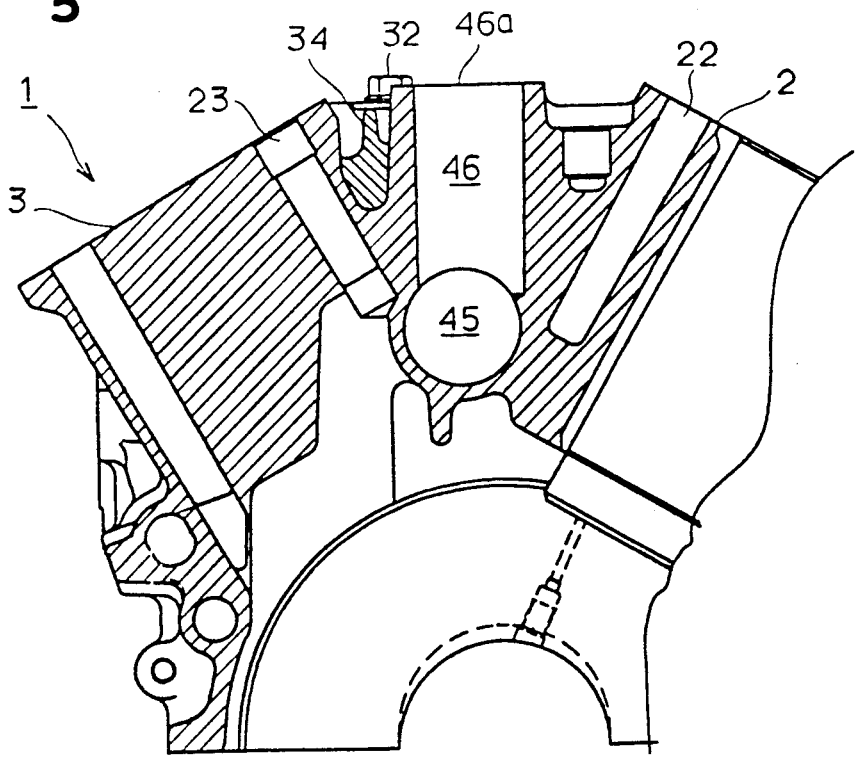
FIG. 5 is a cross-sectional view of FIG. 1 as seen along line V—V.
Figure 6:
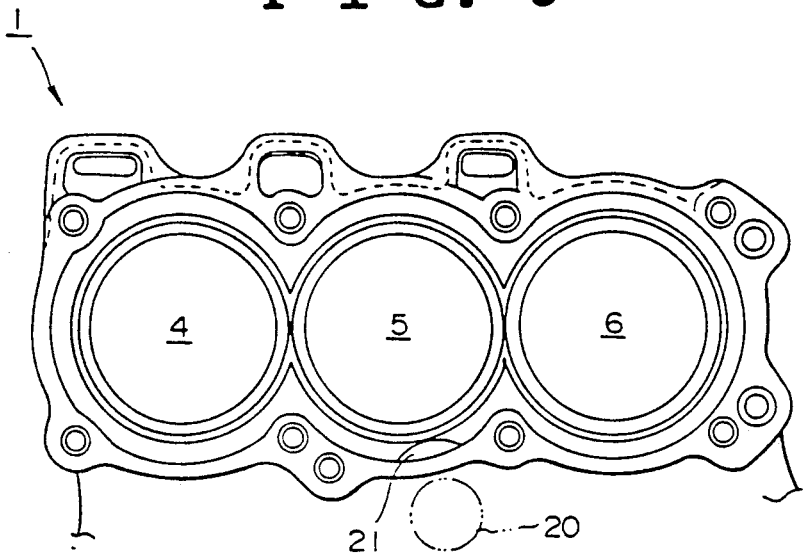
FIG. 6 is an elongated plan view showing one bank of the cylinder block shown in FIG. 1.
Figure 7:
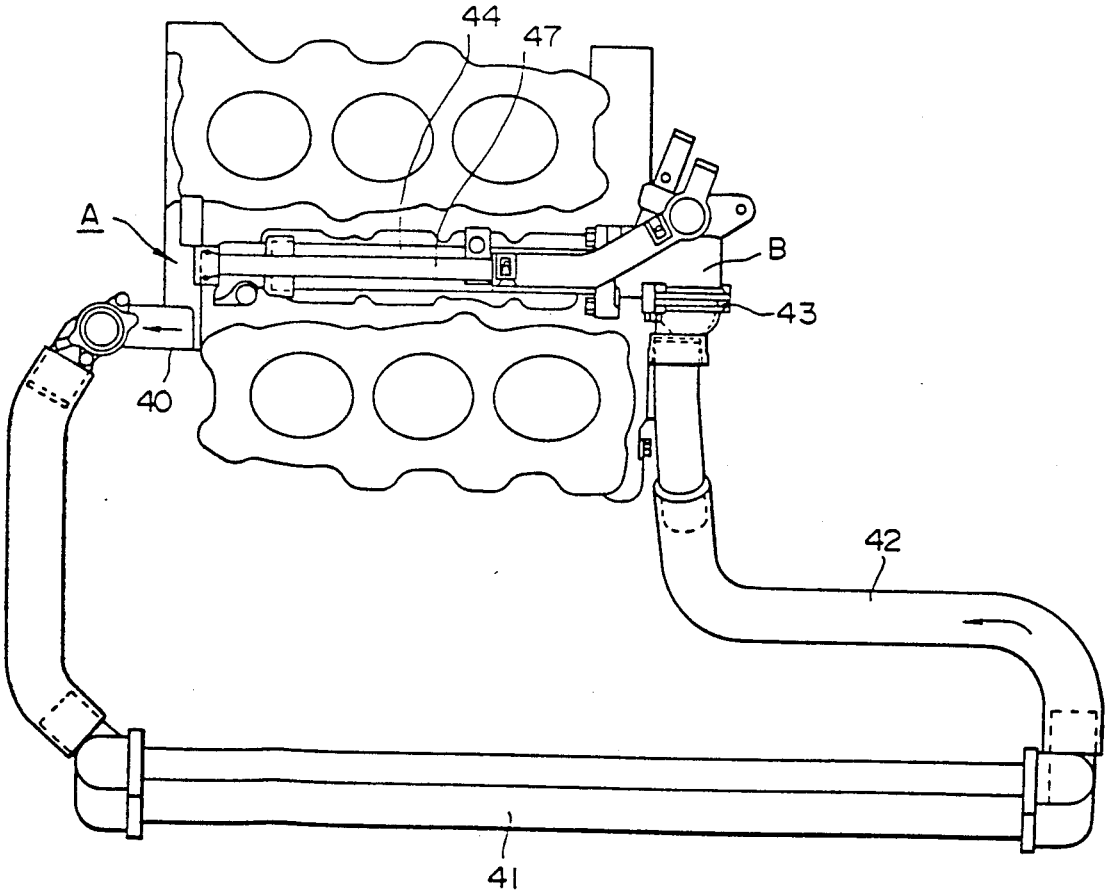
FIG. 7 is a cooling system incorporated in the cylinder block shown in FIG. 1.

As is clearly shown in FIG. 3, the water pump housing 10 receives the rotor 12 operatively therein. Rotor 12 is covered by a cover 11. The housing 10 also receives a rotary shaft 13 and a pulley 14 secured to an outer end of the rotary shaft 13. The pulley 14 is connected or coupled to the crankshaft (not shown) of the engine by a belt, which transmits the engine output to drive the pulley 14.

Figure 2:
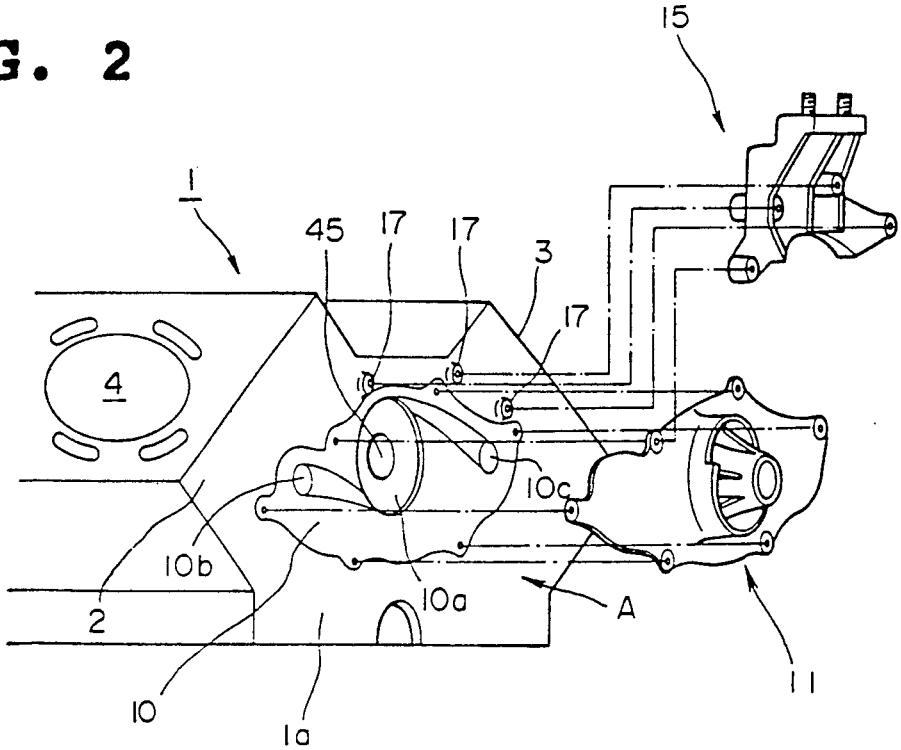
FIG. 2 is an exploded perspective view illustrating the cylinder block shown in FIG. 1.

Cylinder block 1 is provided with a bracket 15 for mounting the cylinder block 1 onto a car body. Bracket 15 is secured to the front wall la above the water pump housing 10 by bolts 16. As is shown in FIG. 2, the front wall 1*a* of the cylinder block 1 is formed with bosses 18 including threaded bores 17 disposed above the water pump housing 10. The inner two of these bosses 18 project into a V-shaped space 19 formed between the first and second cylinder banks 2 and 3.

Cylinder block 1 is formed with a vertical bore 20, surrounded by a bank 21, opening into the V-shaped space 19 at a center portion in a lengthwise direction of the V-shaped space 19. The bore 20 receives therein a knock sensor 24, which itself is well known in the art. As is shown in detail in FIGS. 4 and 5, the bank 21 extends between the center cylinders 5 and 8 of the respective cylinder banks 2 and 3. In more detail, the bank 21 extends beyond water jackets 23 surrounding the center cylinders 5 and 8 of the respective cylinder banks 2 and 3 and adjoins liners 5*a* and 8*a* for the center cylinders 5 and 8. The knock sensor 24 in the vertical bore 20 can detect directly knocking of the cylinders 5 and 8. This avoids or decreases adverse effects of noise produced by the engine, since the threshold sensitivity of the knock sensor 24 to knocking of the cylinders 5 and 8 can be set to a high level.

The cylinder block 1 is further formed, in the V-shaped space 19, with a pedestal 31, such as a lattice or ladder shaped rib, with threaded bores 32 at proper positions. A top wall 30, having its whole length sufficient to extend from the front to the back, in a lengthwise direction, of the cylinder block 1, is secured to the pedestal 31 by bolts 33 so as to cover the knock sensor 24. The pedestal 31 is connected by ribs 34 to the inner bosses 18 provided at the front wall 1*a* of the cylinder block 1. One end of each rib 34 is desirably connected to the pedestal 31 at a portion where the threaded bore 32 is formed. The ribs 34, thus provided, reinforce the bosses 18 attached to the bracket 15. On the other hand, the pedestal 31, connecting the cylinder banks 2 and 3, restrains the movement of the cylinder banks 2 and 3 away from and toward each other, and the cylinder block 1 has a high torsional and a high bending rigidity at the portion where the bosses 18 are formed. This contributes to reducing the transmission of engine vibration to the car body.

Cooling water is introduced from the water pump A through the water inlets 10*b* and 10*c* into the first and second banks 2 and 3, respectively. While the engine is heated, the cooling water in the cylinder block 1 is discharged into a radiator 41 through a water outlet 40 formed in the front wall 1*a*. After being cooled in the radiator 41, the cooling water is returned into the water pump A through the suction opening 45 via a return pipe 42 provided with a thermostat valve 43 disposed at the rear end of the cylinder block 1 and then a suction pipe 44 disposed directly above the top wall 30 in the V-shaped space 19. The suction pipe 44 is connected to the suction opening 45 through a suction passage 46 (see FIG. 8) formed in the cylinder block 1.

Figure 8:
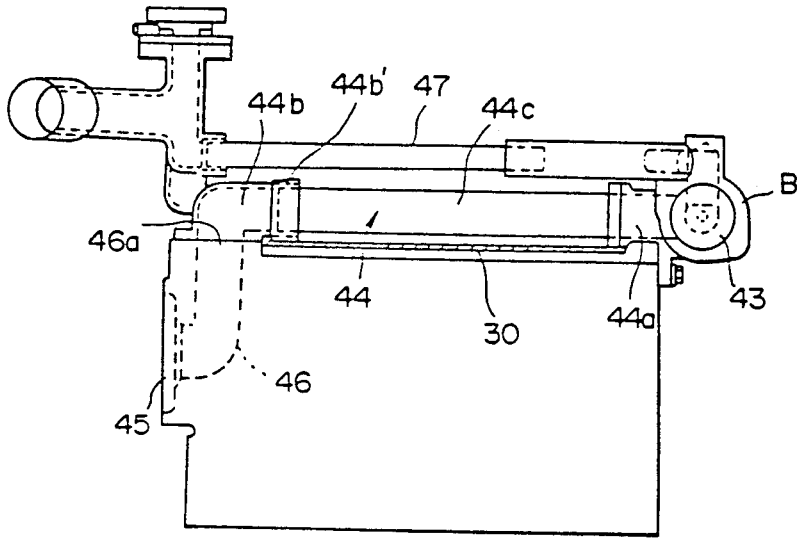
FIG. 8 is a side view of FIG. 7.

While the engine is cooled, the cooling water in the cylinder banks 2 and 3 is introduced to the water pump A through the thermostat valve 43 via a bypass pipe 47 and then the suction pipe 44. The bypass pipe 47 is, as is shown in FIG. 8, disposed above the suction pipe 44 in the V-shaped space 19.

The suction pipe 44 comprises three elemental parts, namely, a first, or rear, connection pipe 44*a* disposed at the rear end of the cylinder block 1, an L-shaped second, or front, connection pipe 44*b* disposed at the front end of the cylinder block 1, and a straight central pipe 44*c* extending in the V-shaped space 19. The first connection pipe 44*a* is secured by bolts 48 (see FIG. 4) to a casing of the thermostat valve 43, which is bolted to the cylinder block 1, at one end, and is connected to the central pipe 44*c* at the other end. The second connection pipe 44*b*, which is bolted to the cylinder block 1, is joined through a boss 44*b* to the central pipe 44*c* at one end and is connected to an opening 46*a* of the suction passage, opening into the V-shaped space 19, at the other end.

According to the structure of the cylinder block described above, because the top wall 30 is bolted to the ladder shaped pedestal 31, extending along almost the whole length of the cylinder block 1 in the V-shaped space 19, and the ladder shaped pedestal 31 is connected to the bosses 18 for mounting the bracket 15, the ladder shaped pedestal 31 is improved in rigidity, so as to effectively restrain the movement of the cylinder banks 2 and 3 away from and toward each other. Therefore, since the cylinder block 1 is prevented from producing vibration, the connection between the L-shaped second connection pipe 44*b* and the straight central pipe 44*c* is prevented from loosening due to vibrations.

Figure 9:
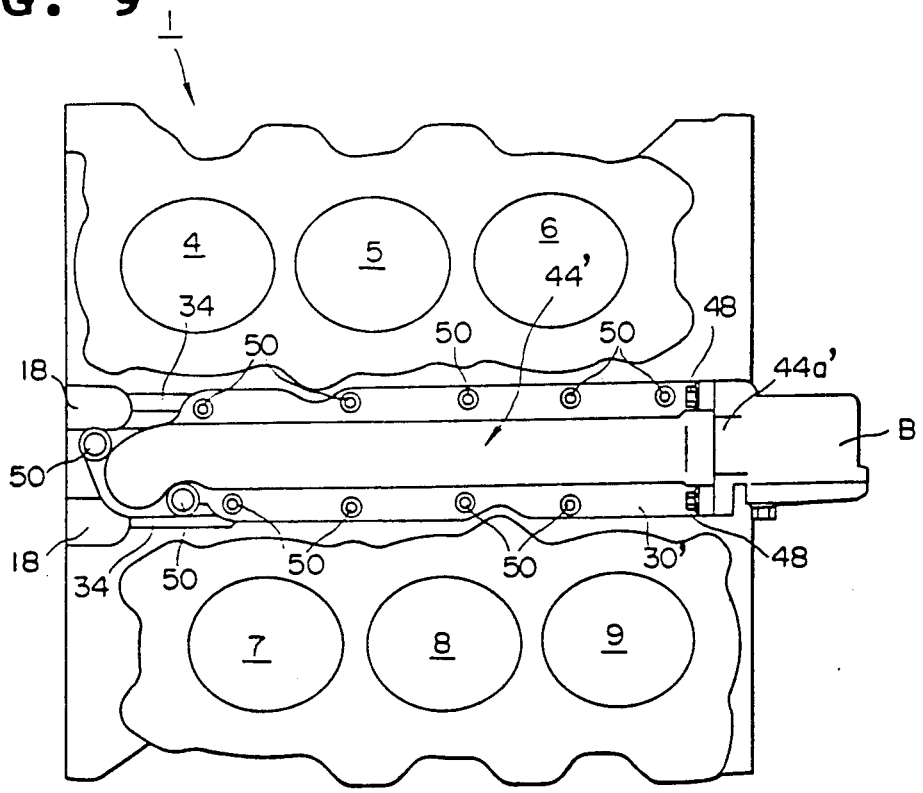
FIG. 9 is a plan view showing a variant of the cylinder block of a V-type internal combustion engine shown in FIG. 1.

Referring to FIG. 9, a variant of the cylinder block according to the preferred embodiment of the present invention described above is shown. The variant shown in FIG. 9 includes a top wall portion 30' with which a suction pipe portion 44' (including the L-shaped second connection pipe 44*b* and the straight central pipe 44*c* of the previous embodiment) is integrally formed as a unit. Installing the unit to the cylinder block 1 is performed simply by securing, at first, the top wall portion 30', by bolts 50, to the ladder shaped pedestal 31, and then securing the suction pipe portion 44', by the bolts 48, to a connecting pipe 44*a'* previously assembled to the casing B of the thermostat valve 43.

According to this embodiment, the top wall is reinforced by the suction pipe partly integrally formed with the top wall. This restrains more effectively the movement of the cylinder banks 2 and 3 away from and toward each other, so as to reduce the vibration produced by the cylinder block 1.

It is to be understood that although the present invention has been described in detail with respect to preferred embodiments thereof, various other embodiments and variants are possible which fall within the scope and spirit of the invention, and such embodiments and variants are intended to be covered by the following claims.

What is claimed is:

1. A cylinder block of a V-type internal combustion engine, comprising:

two cylinder banks, arranged in a V-formation and at a predetermined relative angle so as to form therebetween a V-shaped space, each of said cylinder banks being formed with at least two cylinders;

mounting means integrally formed with said cylinder block in said V-shaped space so as to interconnect said cylinder banks;

a top wall secured to said mounting means over almost the entire length of said V-shaped space in a lengthwise direction of said cylinder block;

a bracket for mounting the cylinder block onto a car body;

a plurality of bosses formed with internal threads for securing said bracket, by bolts, to one end wall of the cylinder block perpendicular to said lengthwise direction, said bosses extending into said V-shaped space; and rib means integrally formed with said cylinder block so as to interconnect said mounting means and said bosses.

2. A cylinder block as defined in claim 1, wherein said mounting means comprises a rib formed substantially in a shape of a ladder.

3. A cylinder block as defined in claim 1, and further comprising a bank integrally formed with said cylinder block in said V-shaped space, said bank extending between cylinders of said cylinder banks which face each other and being formed with a substantially vertical bore for receiving therein a knock sensor for detecting knocking of said cylinders.

4. A cylinder block as defined in claim 1, and further comprising a passage for connecting a water jacket of said cylinder block to a suction pipe of an engine cooling system, said passage being defined by a bore, formed in said cylinder block, with one end opened into said V-shaped space and another end opened in said one end wall.

5. A cylinder block as defined in claim 4, wherein said top wall comprises a wall section secured to said mounting means and a pipe section integrally formed with said wall section for forming part of said suction pipe of the engine cooling system.

* * * * *